United States Patent [19]

Macauley et al.

[11] 4,429,306

[45] Jan. 31, 1984

[54] ADDRESSING SYSTEM FOR A MULTIPLE LANGUAGE CHARACTER GENERATOR

[75] Inventors: George C. Macauley, Concord; William F. Nemecek, Charlotte; Robert W. Roefer, both of Charlotte, all of N.C.

[73] Assignee: International Business Machines Corporation, Armonk, N.Y.

[21] Appl. No.: 300,880

[22] Filed: Sep. 11, 1981

[51] Int. Cl.[3] ..... G09G 1/00

[52] U.S. Cl. ..... 340/790; 340/745; 340/735

[58] Field of Search ..... 340/735, 790, 745

[56] References Cited

U.S. PATENT DOCUMENTS

| | | | |
|---|---|---|---|
| 3,996,584 | 12/1976 | Plager | 340/745 |
| 4,057,848 | 11/1977 | Hayashi | 364/200 |
| 4,122,533 | 10/1978 | Kubinak | 340/790 |

*Primary Examiner*—Marshall M. Curtis
*Attorney, Agent, or Firm*—Karl O. Hesse

[57] ABSTRACT

A method and apparatus are disclosed for addressing a character generator memory containing symbols common to two or more languages in a common area of the character generator memory. Symbols which are special to the particular language being displayed are stored in one of a plurality of special symbol areas of the character generator memory. One of the special symbol areas contiguous with the common area is identified as a default symbol area. The proper special symbol area of the character generator memory is selected by comparing the high order bits of a display character code with compare bits to determine whether a different special symbol area of the character generator memory is to be substituted for the default area contiguous with the common area. If the compare bits indicate that a different special area of the character generator is to be substituted, the high order bits of the display character code are not directly used to address the character generator memory but are replaced by substitution bits to access that special symbol area unique to the language being displayed.

6 Claims, 6 Drawing Figures

FIG. 3A

| | | | | | AREA 1 | | | | AREA 2 | | | | AREA 3 | | | |
|---|---|---|---|---|---|---|---|---|---|---|---|---|---|---|---|---|
| | | | | A12 | 0 | 0 | 0 | 0 | 0 | 0 | 0 | 0 | 0 | 0 | 0 | 0 |
| | | | | A11 | 0 | 0 | 0 | 0 | 0 | 0 | 0 | 0 | 1 | 1 | 1 | 1 |
| | | | | A10 | 0 | 0 | 0 | 0 | 1 | 1 | 1 | 1 | 0 | 0 | 0 | 0 |
| | | | | A 9 | 0 | 0 | 0 | 1 | 0 | 0 | 1 | 1 | 0 | 0 | 1 | 1 |
| | | | | A 8 | 0 | 1 | 0 | 1 | 0 | 1 | 0 | 1 | 0 | 1 | 0 | 1 |
| A7 | A6 | A5 | A4 | | 0 | 1 | 2 | 3 | 4 | 5 | 6 | 7 | 8 | 9 | A | B |
| 0 | 0 | 0 | 0 | 0 | Nu1 | l | a | 0 | @ | P | % | p | | | > | + |
| 0 | 0 | 0 | 1 | 1 | Sp | ¬ | ∈ | 1 | A | Q | a | q | | | ) | — |
| 0 | 0 | 1 | 0 | 2 | Em | & | ∿ | 2 | B | R | b | r | | | ( | ⊼ |
| 0 | 0 | 1 | 1 | 1 | FF | , | ρ | 3 | C | S | c | s | | | ∧ | _ |
| 0 | 1 | 0 | 0 | 4 | NL | # | ω | 4 | D | T | d | t | | | | ⋰ |
| 0 | 1 | 0 | 1 | 5 | Dup | ' | Δ | 5 | E | U | e | u | | | 3 | ⋰ |
| 0 | 1 | 1 | 0 | 6 | Stp | " | ▽ | 6 | F | V | f | v | | | ▶ | × |
| 0 | 1 | 1 | 1 | 7 | | Ø | Q | 7 | G | W | g | w | | | ▭ | ■ |
| 1 | 0 | 0 | 0 | 8 | ¢ | Ø | Φ | 8 | H | X | h | x | | | → | ← |
| 1 | 0 | 0 | 1 | 9 | . | ´ | | 9 | I | Y | i | y | | | ⊘ | ■ |
| 1 | 0 | 1 | 0 | A | ) | ` | £ | : | J | Z | j | z | | | ⇧ | |
| 1 | 0 | 1 | 1 | B | ( | ° | PTS | ; | K | [ | k | { | | | 🚹 | |
| 1 | 1 | 0 | 0 | C | * | ~ | ¥ | < | L | \ | 1 | / | | | | |
| 1 | 1 | 0 | 1 | D | ! | – | ƒ | = | M | ] | m | } | | | ⇩ | |
| 1 | 1 | 1 | 0 | E | $ | ¦ | ⁑ | > | N | ^ | n | ∨ | | | ? | ⊟ |
| 1 | 1 | 1 | 1 | F | + | ⋯ | ⁏ | ? | O | _ | o | — | | | ■ | 🚹 |

| FIG. 3A | FIG. 3B |
|---|---|

ADDRESSING SYSTEM FOR A MULTIPLE LANGUAGE CHARACTER GENERATOR

BACKGROUND OF THE INVENTION

The present invention relates to apparatus for displaying alphanumeric information and more particularly to an improved character generator for a keyboard display terminal or the like. More specifically, the invention relates to a display wherein the characters displayed are in the form of dot patterns selected from a character memory which receives address information from a keyboard or computer identifying the character to be displayed. Part or all of the dot pattern of the character to be displayed is provided at the output of the character memory.

Often, the character memory is embodied in the form of a read only memory integrated circuit module which can be replaced by different read only memory modules to display the different character sets of different languages. More recently, plural languages have been provided in a single character memory and characters common to one or more languages are shared by the languages to avoid the need for duplicating common characters. One such character generating system is disclosed in U.S. Pat. No. 4,122,533. The system of this patent provides a multiplexor 26 and a plurality of language symbol selecting programmable read only memories 44 between the refresh buffer 40 and the character generator read only memory 42. The use of translating or directory memories between the refresh buffer and the character generator presents a significant cost and level of complexity. It is also known that a limited address field can be used with a register of extra bits to access a memory larger than could be defined by the address field alone. The prior art teachings as exemplified by U.S. Pat. No. 4,057,848 are complex and expensive however and not suited for use in a display.

SUMMARY OF THE INVENTION

The present invention provides an improved method and apparatus for addressing a character generator memory wherein symbols common to two or more languages are provided in a common area of the character generator memory in order to minimize the total character generator memory required for all symbols of a plurality of languages. Symbols which are special to the particular language being displayed are stored in one of a plurality of special symbol areas of the character generator memory. One of the special symbol areas contiguous with the common area is identified as a default symbol area. The proper special symbol area of the character generator memory is selected by comparing the high order bits of a display character code with compare bits to determine whether a different special symbol area of the character generator memory is to be substituted for the default area contiguous with the common area. If the compare bits indicate that a different special area of the character generator is to be substituted, the high order bits of the display character code are not directly used to address the character generator memory but are replaced by substitution bits to access that special symbol area unique to the language being displayed.

PREFERRED EMBODIMENT OF THE INVENTION

Figure 1:
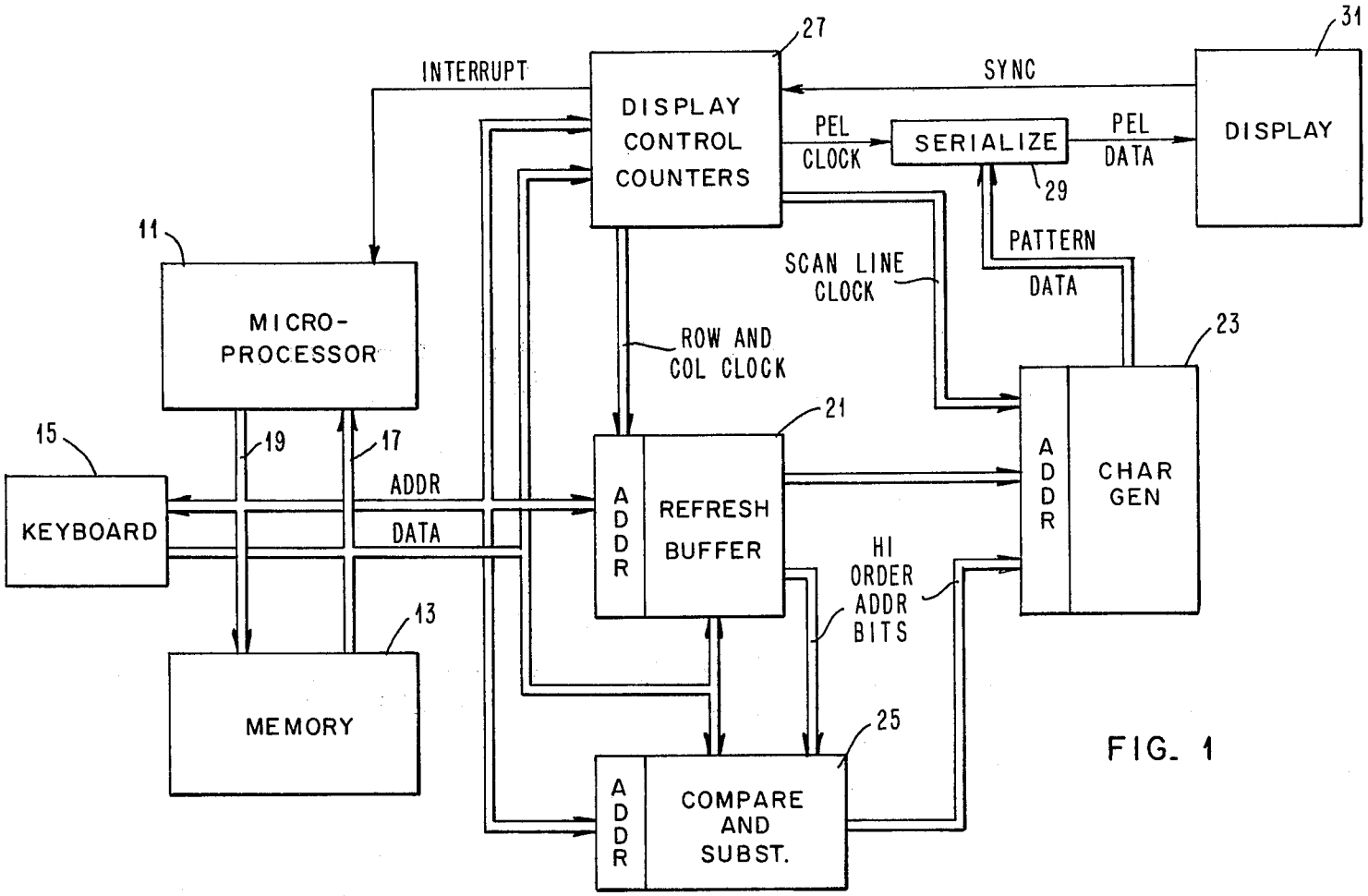
FIG. 1 shows a block diagram of a microcomputer controlled keyboard display including the invention.

FIG. 1 shows a keyboard display incorporating the invention. The keyboard display is controlled by a microprocessor 11 and a program in memory 13. Keyboard scan codes are received from keyboard 15 on the data bus 17 and translated into codes for storage and display. For example, the data can be translated into ASCII or EBCDIC. After translation, the input codes can be stored in memory 13 and transferred to refresh buffer 21. Refresh buffer 21 and registers in compare and substitution logic 25 may be memory mapped into the addressable memory space of microprocessor 11. From refresh buffer 21, characters to be displayed are used as part of the address to access character generator read only memory 23. The high order bits of each display character code stored in refresh buffer 21 are sent to compare and substitution circuitry 25 for comparison with bits stored in the compare register. If a compare occurs, substitution bits stored in the substitution register are sent to the high order address inputs of character generator read only storage 23. The low order bits of each display character code stored in refresh buffer 21 are used directly as intermediate address bits to character generator memory 23. The low order address bit inputs to character generator 23 are provided by the scan line clock output from display control counters 27. Display control counters 27 generate the bit clock, the scan line clock, and the row and column clock. Each of these clocks is provided by an output from one or more counters which provide a digital time base operating in synchronism with the display, in this embodiment a cathode ray tube. The display control counters remain in sync because the display periodically provides a sync pulse to the display control counters. The display control counters provide a row and column clock to the address input of refresh buffer 21. The row and column clock controls access to refresh buffer 21 storage locations while refreshing the cathode ray tube display. The character codes from refresh buffer 21 are provided on its data output and form part of the address to the character generator. The scan line clock provides the remaining or low order address bits. For any scan line, the scan line clock remains at a particular count while the refresh buffer provides a different character code for each column. In this way the character generator 23 provides a byte of pattern data to serializer 29 for each character column of each display raster scan line. The byte of data in serializer 29 is then shifted to the display as picture element data by the picture element clock. Referring again to compare and substitution logic 25, connections are provided via address bus 19 and data bus 17 to microprocessor 11 for loading the compare and substitution registers. The registers in logic 25 are also memory mapped into the address space of microprocessor 11 so that microprocessor 11 can load values into the compare and substitution registers in the same manner that it stores a byte in any other memory location.

In an alternate embodiment of applicants' invention, the compare and substitution registers are connected to the output of the refresh buffer rather than the output of microprocessor 11. Connection to the output of refresh buffer 21 permits the compare and substitution registers to be loaded by display control orders rather than the microprocessor 11. Providing the ability to load the compare and substitution registers from the refresh buffer permits each field of display data to be proceded by a display order which controls the language of the field on a field by field basis. This alternate embodiment of applicants' invention is described in more detail later with respect to FIG. 4. By use of the above described compare and substitution registers, two high order address bits of each eight bit display character code can be converted into three high order address bits to access a particular section of character generator 23 to display a particular language without the need for directory memories or physically changing the character generator memory.

Figure 2:
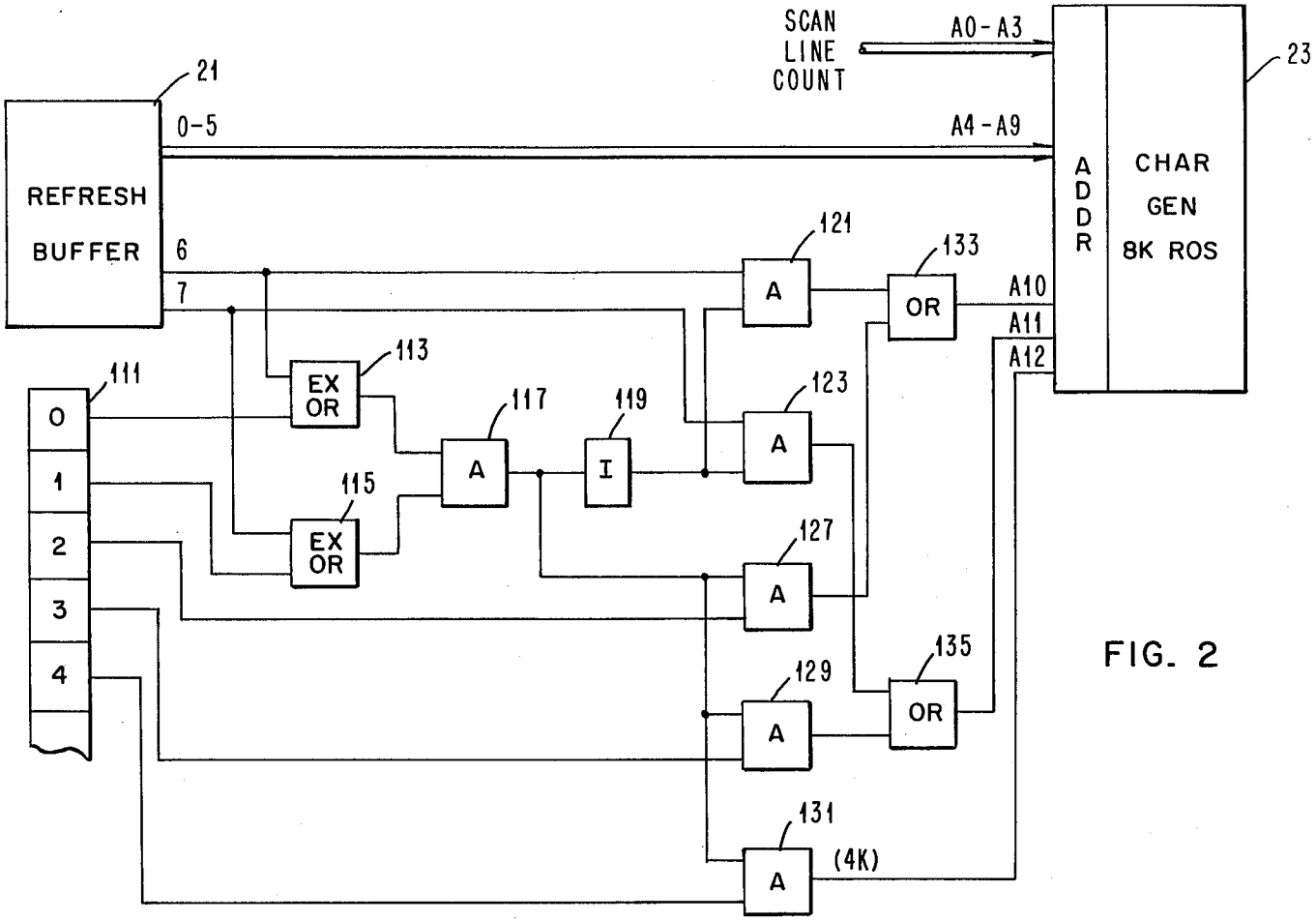
FIG. 2 shows more details of those portions of FIG. 1 including the invention.

Referring now to FIG. 2, refresh buffer 21 and character generator 23 are shown in combination with the compare and substitution logic in greater detail. In the preferred embodiment of applicants' invention, the compare register and the substitution register are combined into one eight bit register 111. Only the first five bits of this eight bit register are utilized for the invention in this limited embodiment. The first two bits, namely the zero bit and the one bit, comprise the compare bits and the next three bit positions, namely bits 2, 3, and 4, store the substitution bits. In this way, a single byte command or display order can change the language of the display.

Referring now to the character generator memory 23, it can be seen that the scan line counter from display control counters 27 provide the four lowest order address lines A0 through A3. Each character code output provided by refresh buffer 21 provides the remainder of the address. Character code bits 0 through 5 of each character code are used directly to provide address lines A4 through A9 to character generator memory 23. Bits 6 and 7 of each display character code are provided to the compare and substitution logic which generates address inputs A10, A11, and A12.

The compare means of the invention is embodied in exclusive OR invert circuits 113 and 115 having outputs connected to AND gate 117. Exclusive OR invert gate 113 has inputs connected to display character code bit 6 and to the compare register bit 0. Exclusive OR invert gate 115 has inputs connected to the display character code bit 7 and the compare register bit 1. The output of AND gate 117 is inverted by inverter 119 to condition gates 121 and 123. When bit 6 or 7 of the display character code is different from compare bit positions 0 or 1 of register 111, a character in the common area is to be displayed. Gates 121 and 123 then provide the address bits A10 and A11 to access a display character stored in the common area of character generator memory 23. AND gates 127, 129 and 131 are provided to transfer the substitution bit pattern from substitution bit positions 2, 3, and 4 of register 111 to address input lines A10, A11 and A12 whenever bits 6 and 7 of the display character code are the same as the bits stored in compare bit positions 0 and 1 of register 111. OR gates 133 and 135 connect AND gates 121, 127 and 123, 129 to address inputs A10 and A11 respectively to provide these address inputs under both compare and noncompare conditions. The output of AND gate 131 can be connected directly to the address input A12 because in the instant embodiment, the common area of character generator memory 23 is in the first half of the memory and therefore the A12 bit is a zero when this area is accessed. The A12 address lines will only be a logical one when special symbol areas of the memory are being accessed. Accordingly, a noncompare condition provided by the compare logic causes gate 131 to provide a logical zero to address line A12 effectively accessing the common area of character generator memory 23.

Figures 3, 3B:
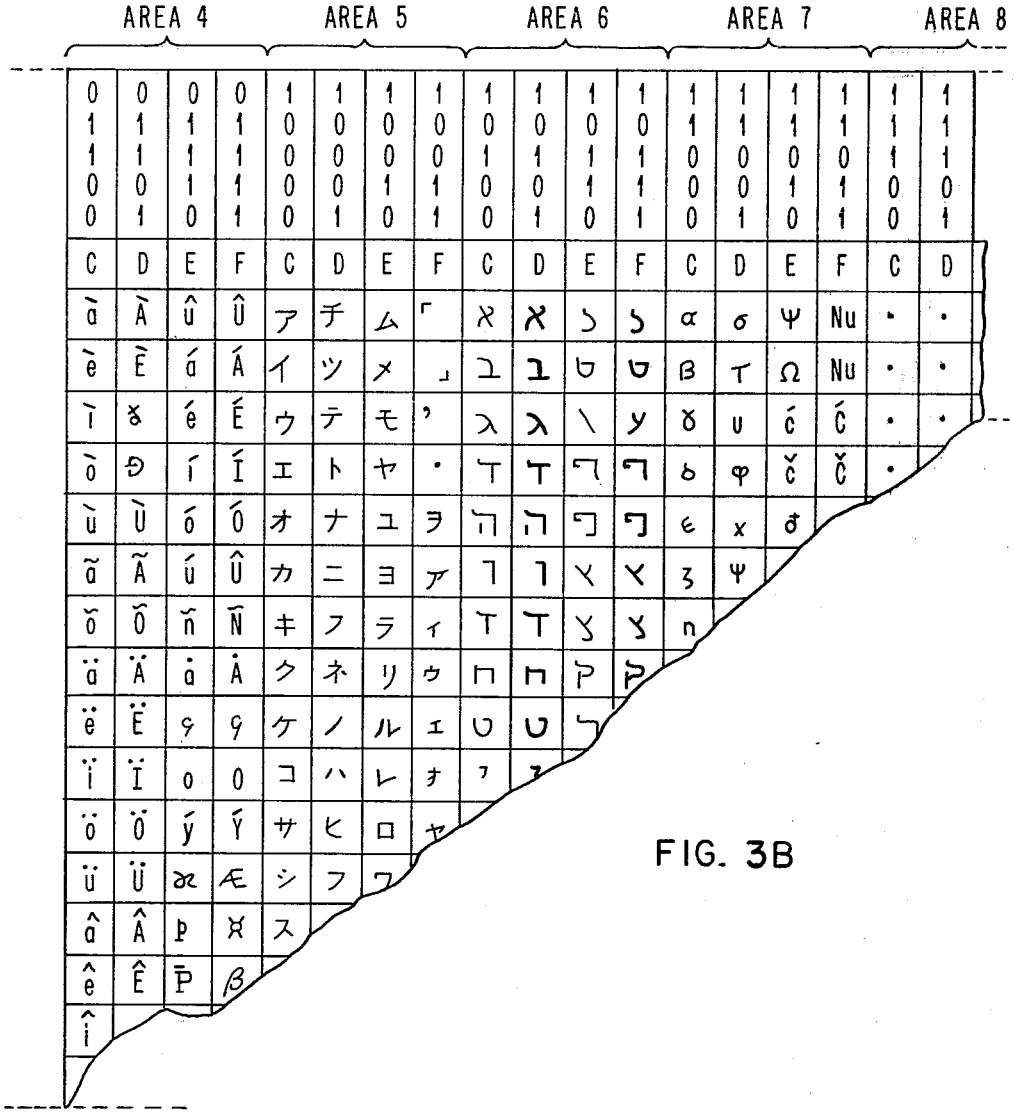
FIG. 3 consisting of FIGS. 3A and 3B is a table showing the location of common, default, and special picture element patterns in the character generator memory.

Referring now to FIG. 3, an example placement of character patterns in character generator memory 23 is shown. The lowest order address lines A0 through A3 are not shown in FIG. 3 because the patterns themselves are not shown at the picture element level. Rather symbolic images of the characters are shown at the intersection of rows and columns having corresponding bit patterns which would access the first slice of pattern data of the selected character. Address bit pattern combination for address lines A4 through A7 are shown down the lefthand side of FIG. 3 while address bit combinations for address lines A8 through A12 are shown across the top of FIG. 3. Address bits A10, A11 and A12 control selection of area 1 through area 8 of the memory. In the instant embodiment, address line A12 is a logical zero for the common and default areas of the memory. Therefore area 1 through area 4 includes the common and default areas. The default area can be any one of area 1 through area 4 as defined by the bits stored in compare bit positions 0 and 1 of register 111. If register 111 contains all zeros, area 1 will be the default area. Even though bits 6 and 7 are the same as bits 0 and 1 of register 111 causing substitution, the default area is substituted for itself. If bit positions 0 and 1 contain ones and bit positions 2, 3 and 4 contain a binary 110, area 4 becomes the default area.

If a special symbol area of memory 23 is to be substituted for a default area, substitution bit position 4 of register 111 must be loaded with a binary 1. For example, if register 111 contains 11001, area 5 containing the special symbols unique to katakana and Japanese English will be accessible in combination with areas 1, 2 and 3 containing the Latin alphabet and control symbols common to both English and Japanese English. Likewise the bit pattern 11101 will select area 6 in combination with areas 1, 2 and 3 to display languages using the Latin alphabets plus special Hebrew characters. A bit pattern of 11011 in register 111 will give access to areas 1, 2, 3 and 7 of character generator memory 23 to display information in languages using the Latin alphabets plus Greek, Yugoslav, and Turkish language information. In the last recited examples, areas 5, 6 or 7 were substituted for default area 4 which includes symbols special to Iceland, Hungary and Africaans.

Figure 4:
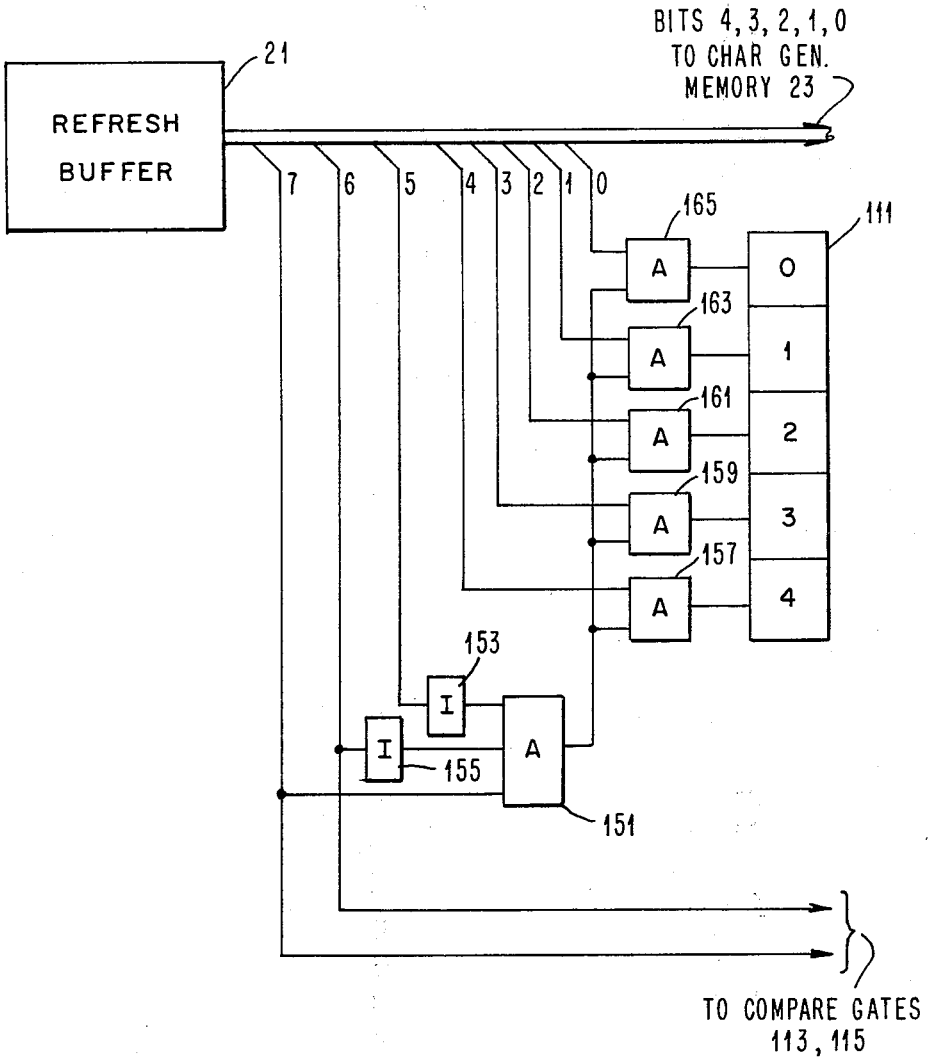
FIG. 4 shows an alternate embodiment of the invention.

Referring now to FIG. 4, an alternate embodiment of the means for loading compare and substitution bits into register 111 will be described. In FIG. 4, all eight display character code output bits are provided to a plurality of control logic gates for loading register 111. Bits 7, 6 and 5 are provided to AND gate 151, bits 6 and 5 being inverted by inverters 153 and 155. AND gate 151 identifies the first two columns of area 3 shown in FIG. 3. FIG. 3 shows that these first two columns contain blanks. That is, no displayable symbol patterns appear at these locations. Instead, these display character codes can be used as display orders for loading register 111. Having dedicated display character code bits 7, 6 and 5 as the control bits which cause loading of register 111, display character code bits 4, 3, 2, 1 and 0 are gated directly through AND gates 157, 159, 161, 163, 165 into corresponding storage positions of register 111.

The embodiment of FIG. 4 avoids the need for the processor to load the register 111 directly and permits display orders controlling the loading of register 111 to be embedded in the display character code stream. In this way, fields being displayed can each, be easily displayed in a different language.

Having described the instant invention in terms of the compare and substitution logic of FIGS. 2 and 4, it will be apparent to those skilled in the art that a dedicated microprocessor could be microprogrammed to perform the logical functions performed by the compare and substitution logic. This will be particularly advantageous where other parts of the display such as the decoding of display orders to permit text editing and control the display presentation such as reverse video and cursor control are already implemented by a dedicated microprogrammed microprocessor. In such case, the instant invention can be incorporated into the display by inclusion of a small number of microprogram instructions without any significant cost other than the cost for the larger character generator memory.

We claim:

1. A method of retrieving picture elements from a character generating memory for display of a symbol comprising the steps of:

providing a first plurality of bits of a display character code as part of an address to an address input of said memory;

providing at least one compare bit:

comparing another bit of said display character code with said compare bit and;

substituting a plurality of bits for said another bit of said display character code as another part of said address to said address input of said memory, responsive to the result of said comparison in order to select a symbol which is special to a particular language;

whereby a selected portion of said memory may be accessed alternatively to another selected portion of said memory.

2. In a character generator including a memory for storing the picture elements of a set of characters and a source of character codes, the improvement comprising:

first storage means for storing n compare bits;

second storage means for storing at least n+1 substitution bits;

compare means for comparing the n high order bits of one of said character codes with said n compare bits;

logic means responsive to the output of said compare means for gating at least n+1 substitution bits from said second storage means to the address input of said memory.

3. A character generator comprising:

a memory having a common symbol area, a default special symbol area, and at least one selectable special symbol area;

compare means for comparing n bits of a character code with n bits designating said special symbol areas;

substitution means responsive to said compare means for providing at least n+1 address bits designating a specific one of said special symbol areas.

4. The method of claim 1 further comprising the steps of:

storing, responsive to at least one bit of another display character code, a plurality of bits of said another display character code as said compare bit and said substitute bits.

5. The character generator of claim 2 wherein said register further comprises a compare field for storing said n bits and a substitution field for storing and substitution bits.

6. The character generator of claim 2 further comprising control logic for storing in said register, a plurality of bits of a display character code which is a display order.

* * * * *

UNITED STATES PATENT AND TRADEMARK OFFICE

CERTIFICATE OF CORRECTION

PATENT NO. : 4,429,306

DATED : January 31, 1984

INVENTOR(S) : George C. Macauley et al.

It is certified that error appears in the above-identified patent and that said Letters Patent is hereby corrected as shown below:

Claim 5, line 3, "and", second occurrence, should read -- said --.

Signed and Sealed this

*Thirteenth* Day of *May 1986*

[SEAL]

*Attest:*

DONALD J. QUIGG

*Attesting Officer*

*Commissioner of Patents and Trademarks*